United States Patent [19]

Godin et al.

[11] Patent Number: 4,979,246

[45] Date of Patent: Dec. 25, 1990

[54] SUPPORT FRAME AND EXTENDER FOR AN ADJUSTABLE BED

[75] Inventors: William N. Godin; Viktor Balanevsky, both of Williamsville; Jerome Betteker, Cheektowaga, all of N.Y.

[73] Assignee: Hard Manufacturing Co., Inc., Buffalo, N.Y.

[21] Appl. No.: 485,223

[22] Filed: Feb. 26, 1990

[51] Int. Cl.[5] ..... A61G 7/00

[52] U.S. Cl. ..... 5/67; 5/424; 5/100

[58] Field of Search ..... 5/67, 53 R, 424, 100, 5/99 R, 157, 183

[56] References Cited

U.S. PATENT DOCUMENTS

| | | | |
|---|---|---|---|
| 522,342 | 7/1894 | Helander | 5/184 |
| 912,214 | 2/1909 | Ward | 5/67 |
| 2,724,127 | 11/1955 | Trivas et al. | 5/53 R |
| 3,064,278 | 11/1962 | Broyles | 5/184 |
| 4,768,240 | 9/1988 | Benoit | 5/53 R |

FOREIGN PATENT DOCUMENTS

| | | | |
|---|---|---|---|
| 2083744 | 3/1982 | United Kingdom | 5/67 |

*Primary Examiner*—Gary L. Smith
*Assistant Examiner*—Machael J. Milano
*Attorney, Agent, or Firm*—Sommer, Oliverio & Sommer

[57] ABSTRACT

The invention provides an improved support frame and extender for an adjustable bed which comprises an inclinable head frame portion 14 and an adjustable extender 19 slideably mounted on said head frame to bridge the space, S, between the head frame and the bed's post and filler apparatus 12 independent of the head frame angle of incline. The extender is slidably fastened to the head frame through the use of extender brackets 39 and is further supported by support bracket 40 and is interposed between the post 29 and first filler rod 36 of the post and filler assembly. As the head frame is inclined causing the space S to increase, the extender can be mannually slided to bridge the space thereby preventing inadvertant patient injury.

16 Claims, 3 Drawing Sheets

SUPPORT FRAME AND EXTENDER FOR AN ADJUSTABLE BED

TECHNICAL FIELD

The present invention relates generally to the field of adjustable beds and cribs, and specifically, to an improved mattress support frame and extender for reducing the incidence of inadvertent patient injury.

BACKGROUND ART

In response to advances in medical treatment, various types of adjustable beds and cribs have been developed to properly support and position treating patients. In particular, it is known to incorporate as part of a hospital bed or crib an adjustable mattress support frame capable of folding or bending in conformance with the natural anatomical bending of a patient's waist and knees. Adjustability of the mattress support frame enables a generally supine patient to be positioned at desired angles of incline for treatment and comfort.

For example, it may be important to be able to position a patient in the "sitting" position, i.e., bent at the waist, yet still have the patient be supported by the underlying mattress and support frame. This, of course, requires that the head portion (i.e., from the waist up) of the support frame be adjustable through various angles of incline.

Similarly, the adjustability feature is desirable and is often used with cribs or children's beds, which typically also include safety rails or a post and filler apparatus extending upwardly from each side of the crib frame to prevent a young patient from inadvertently falling out of bed. The use of these types of safety devices with adjustable cribs has, however, resulted in a potential safety problem. Specifically, when, for example, the head portion of an adjustable mattress support frame is inclined, a gap or space is created between the top of the head frame portion and the post and filler apparatus extending upwardly from the crib frame. This space can prove dangerous to young patients, or even disoriented adults, who may climb or fall through the space or become trapped between the top of the head frame and the post and filler apparatus.

Accordingly, it is desirable to have a support frame that, upon inclination, is easily extendable to traverse or bridge the space created between the support frame and the post and filler apparatus to prevent a patient from falling through the space or being trapped therebetween.

DISCLOSURE OF THE INVENTION

The present invention generally comprises an improved head portion of a support frame and an adjustable extender for use with a hospital crib or bed (e.g., 10). The invention specifically includes a generally U-shaped head frame portion (e.g., 14) adapted to support the head of a matress; a generally U-shaped extender (e.g., 19) slidably connected to the head frame and supported through the use of extender brackets (e.g., 39) and support brackets (e.g., 40), and capable of manually or otherwise being slided toward and away from the head frame. The extender is further adapted to slide vertically within a post and filler safety apparatus (e.g., 12) as the head frame is adjusted to a desired incline angle. As the head frame is inclined, the variable space (e.g., S) between the head frame and post and filler apparatus is bridged by the extender and extender cross members (e.g., 25).

Accordingly, the general object of the invention is to provide an extender for an adjustable mattress support frame for a crib or bed.

Another object of the invention is to provide an extender that is adapted to continually bridge the space between the support frame and post and filler apparatus of an adjustable crib or bed, independent of the angle of incline.

Still another object of the invention is to provide an improved support frame and extender that is easily manually adjustable.

These and other objects and advantages will become apparent from the remainder of the written specification, the drawings, and the appended claims.

MODE OF CARRYING OUT THE INVENTION

Figure 1:
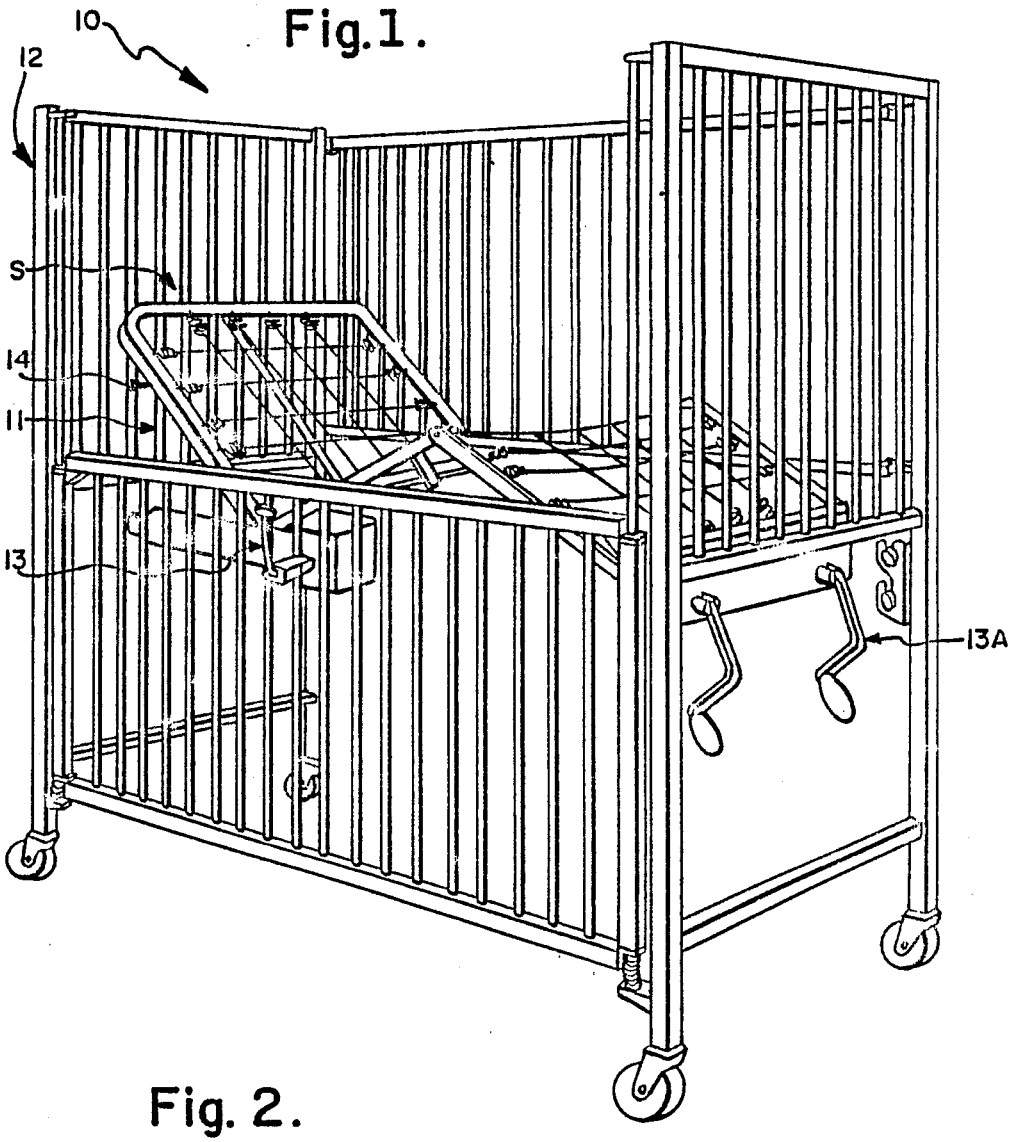
FIG. 1 is a perspective view of a typical hospital crib having an adjustable mattress support frame and a post and filler safety apparatus.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The present invention provides an improved support frame and extender for use with an adjustable hospital crib or bed. In practice, the invention serves to improve the safety of the crib or bed by being adapted to continuously bridge the space created between the end of the head frame portion of the support frame and the crib's post and filler safety apparatus when the head frame is inclined.

Turning first to FIG. 1, a typical hospital crib 10 is shown to generally include an adjustable mattress support frame 11 having a head frame portion 14; a post and filler safety apparatus 12 arranged to provide a safety "wall" or "rail" on each side of the crib or bed, and adjustment mechanisms 13, 13A for adjusting the angle of incline of various portions of the support frame including the head frame. Upon inclination of the head frame, however, a space, S, is created between the head frame and post and filler apparatus thereby resulting in a potential safety hazard for young or disoriented patients. The present invention solves this problem by providing an extender that is interposed between the head frame and post and filler apparatus and that bridges space S independent of the head frame incline angle.

Figures 3, 4, 5, 6:
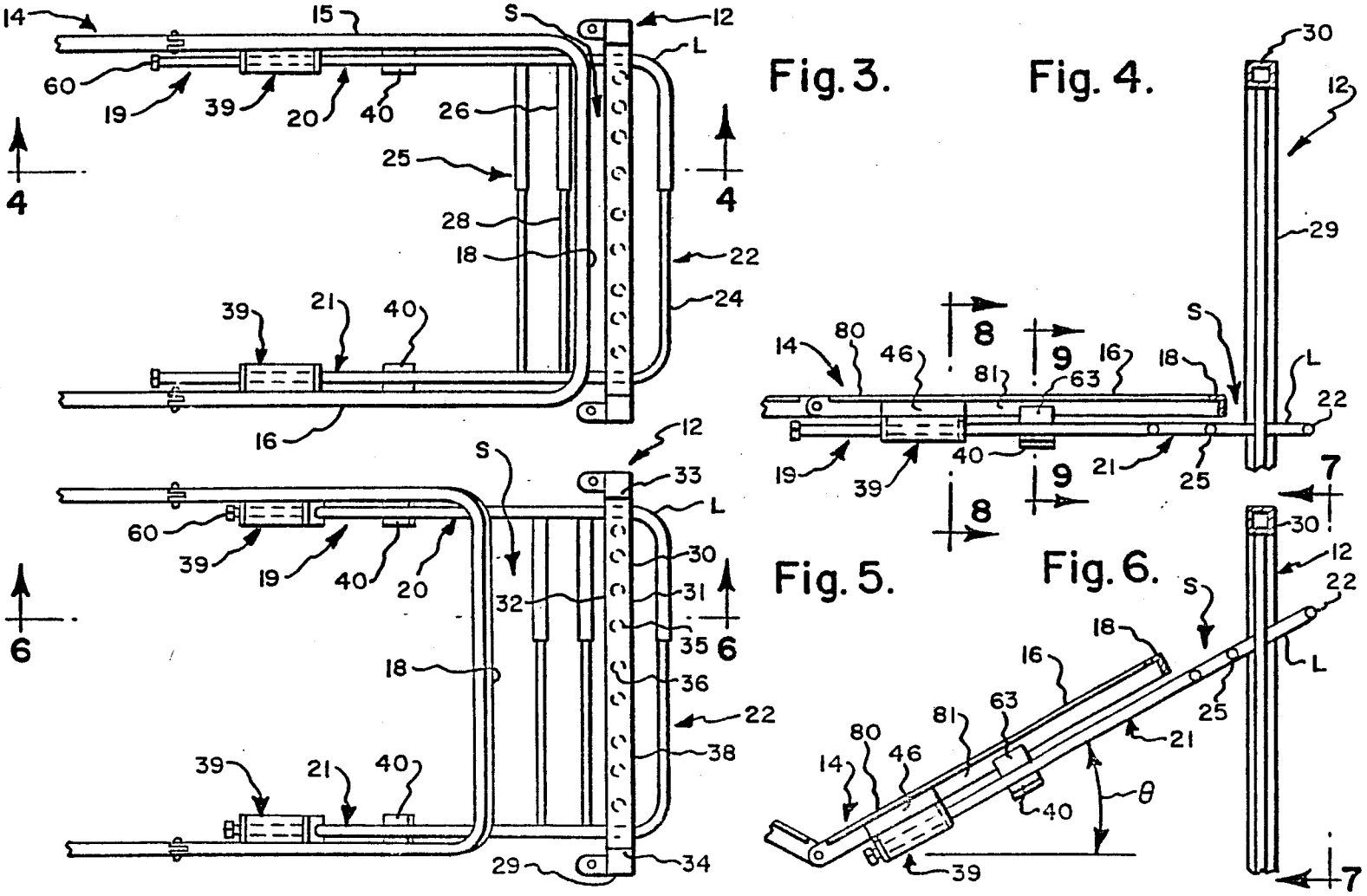
FIG. 3 is a transverse sectional view of the invention showing the head frame in a horizontal position.
FIG. 4 is a longitudinal sectional view of the invention shown in FIG. 3 with the head frame in a horizontal position.
FIG. 5 is a transverse sectional view of the invention showing the head frame in an inclined position and the extender bridging the space between the head frame and post and filler apparatus.
FIG. 6 is a longitudinal sectional view of the invention as shown in FIG. 5, with the head frame inclined at an angle, $\theta$.

Adverting to FIGS. 3–6, the invention is shown and illustrated with the head frame in a horizontal position (FIGS. 3, 4) and with the head frame inclined at an angle $\theta$ (FIGS. 5, 6). Turning in particular to FIG. 3, the head frame 14 is shown to be an integrally formed generally U-shaped member having a left leg 15, a right leg 16, and a transverse end portion 18 joining the left and right legs at their ends. As is generally shown in FIG. 1, the head frame supports the head portion of the crib's mattress through the use of cross-wires and springs interposed within the frame. Adverting to FIG. 8, the head frame is, in cross-section, a generally inverted L-shaped thin walled member, usually constructed of steel, aluminum or any suitable alloy, and includes a top horizontal planar surface 80 and a vertically downwardly extending planar outside surface 81. Accordingly, the "open" portion of the inverted L-shaped head frame faces inwardly toward the mattress support springs and wires, shown generally in FIG. 1.

Referring now to FIGS. 1 and 3–6, the head frame is arranged such that the transverse end portion 18 thereof is parallel to and in spaced relation with the crib's post and filler safety apparatus 12. Accordingly, a space, S, exists between the head frame transverse end portion and the post and filler apparatus. Space S unavoidably becomes larger as the head frame is inclined from the horizontal position (FIG. 4) to an angle of incline, $\theta$ (FIG. 6).

Adverting to FIG. 3, an extender 19 is shown to be a tubular member which includes a left leg 20 and a right leg 21. Both the left and right leg are, at one of their respective ends, integrally formed to an angle of approximately 90° which results in each leg having a substantially "L" shaped end portion 23,24. In addition, left leg end portion 23 and right leg end portion 24, although both tubular, are of slightly different diameter. Accordingly, upon assembly, the left leg end and right leg end are slideably joined to form an extender intermediate end portion 22. This sliding engagement of the extender legs and their respective end portions results in the extender U-shape of the assembled extender shown by the various drawing figures (e.g., FIGS. 3, 5).

Continuing to advert to FIG. 3, the extender is shown to further include a plurality of spaced crossmembers 25 arranged parallel to the extender transverse end portion and attached, at either of their ends, to the extender left and right legs. The crossmembers are comprised of two tubular portions, a left portion 26 attached to the extender left leg, and a right portion 28, attached to the extender right leg. The left and right crossmember portions are of different diameter and are slideably engaged upon assembly in the identical manner as the extender left leg end portion and right leg end portion. Thus, as is shown in FIGS. 3 and 5, the preferred embodiment of the generally U-shaped extender also includes two spaced crossmembers joining the left and right extender legs and parallel to the extender intermediate end portion.

Figure 7:
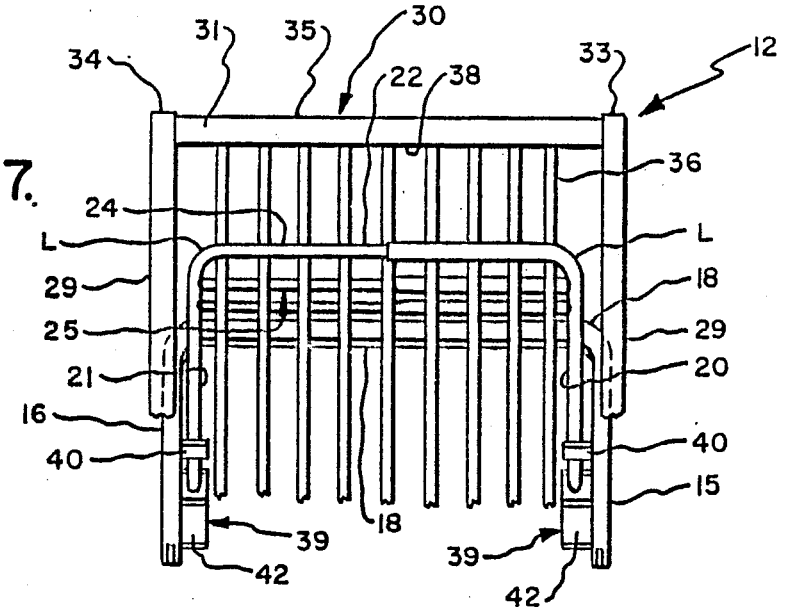
FIG. 7 is an end view of the post and filler apparatus and extender with the head frame in an inclined position.

Adverting now to FIGS. 3, 5 and 7, extender 19 is shown to be generally mounted on head frame 14 and to extend through the adjoining post and filler safety apparatus 12. Referring specifically to FIG. 5, the post and filler apparatus is shown to be comprised of a hollow elongated top member 30 having a generally square cross-section comprised of an outwardly facing planar surface 31, and inwardly facing planar surface 32, a planar top surface 35 and a planar bottom surface 38. Top member 30 also includes open left end 33 and open right end 34. Attached at either end of top surface 30 are vertically and downwardly extending substantially rectangular hollow end posts 29. The end posts extend to the crib wheel mounts, shown generally in FIG. 1, and serve as the primary supports for the crib or bed frame. As shown in FIG. 7, the post and filler apparatus further includes a plurality of filler rods 36, generally cylindrical in shape, spaced between the end posts 29 and mounted and extending vertically downwardly from top member bottom surface 38. The filler rods act as vertical "guard rails" to prevent the patient from falling or climbing out of the crib or bed.

Figure 2:
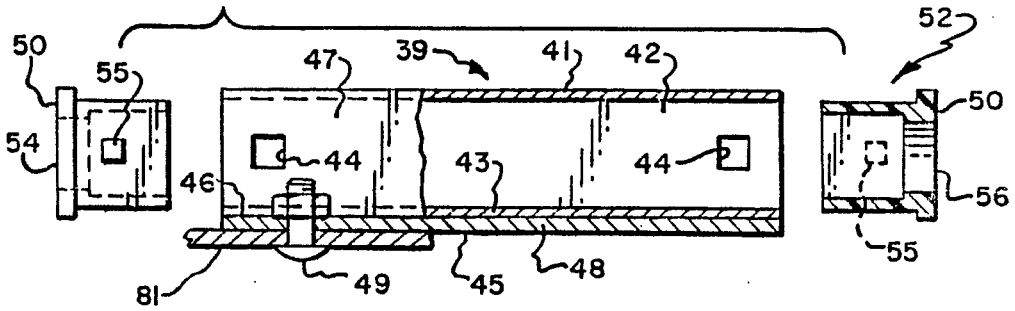
FIG. 2 is an exploded fragmentary longitudinal sectional view of a support bracket for slideably securing a leg portion of the extender.
Figure 8:
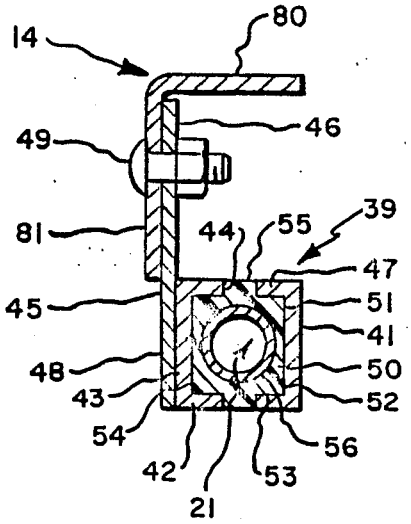
FIG. 8 is transverse vertical sectional view of an extender bracket taken along line 8—8 of FIG. 4.

Continuing to advert to FIGS. 3, 5, and 7, the extender is generally shown to be mounted and supported on the head frame by a pair extender brackets 39 and support brackets 40. Extender bracket 39 is shown in FIGS. 2 and 8 to specifically comprise an elongated hollow rectangular body member having planar side surfaces 41 and 43, planar top surface 47 and planar bottom surface 42. The ends of the support bracket are "open" and are adapted to receive a rectangular bushing 52 comprised of top planar surface 51, bottom planar surface 53, vertical planar side surfaces 52 and 54 and a facing planar end surface 50, slideably fitted into the "open" ends of the extender bracket. As shown in FIGS. 2 and 8, a circular aperture 56 though end surface 50 is adapted to slideably receive an extender leg, e.g., 21. Bushing 52 is secured to the support bracket body member through the alignment of companion through-holes 44 on the support bracket body member and 55 on the bushing. A bolt or other securing device is inserted into the aligned through-holes to prevent the bushing from moving in response to any sliding movement of the extender legs or any other random movement of the crib or bed. Referring to FIG. 8, extender bracket 39 is mounted to the head frame through the use of a thin-walled vertically downwardly extending connector 45 comprised of an upper portion 46 and a lower portion 48. In particular, upper portion 46 is aligned with and bolted to head frame bottom outside surface 81 by bolt 49. Similarly, extender bracket surface 43 is welded or otherwise attached to connector lower portion 48, and the extender bracket is thereby mounted on the head frame legs.

Referring to FIGS. 3 and 5, the extender is mounted on the head frame by slideably inserting the extender legs into the corresponding support bracket and bushing aperture; e.g., the left extender leg is inserted into the support bracket mounted on the left leg of the head frame. A stop cap 60 is placed over the end of each extender leg after insertion through the support bracket to prevent the leg from inadvertently sliding out of the support bracket and bushing.

Figure 9:
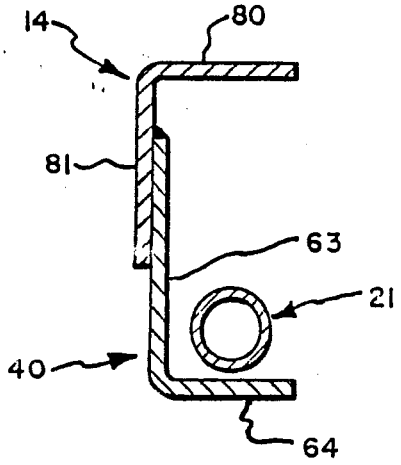
FIG. 9 is a transverse vertical sectional view of a support bracket taken along line 9—9 of FIG. 4.

Turning now to FIG. 9, the extender legs are further supported by support brackets 40. Specifically, the support brackets are step-like, thin-walled members mounted on the head frame at a point between the extender brackets and the head frame cross-members. The support brackets are integrally formed of steel or any other suitable material and include a vertically downwardly extending planar surface 63 and a horizontal rightwardly extending planar surface 64. The support bracket is mounted on head frame outside surface 81 by the alignment of and welding or other connection of vertical surface 63 thereto. The length of support bracket horizontal surface 64 is such that it is sufficient to accommodate the diameter of the extender legs. Upon assembly, the extender legs, after insertion into the support brackets, rest, in part, just above surface 64 of the support bracket which insures the stability and strength of the extender as it is slided into position.

Although slideably mounted to the head frame, the extender is also specially positioned with respect to the post and filler apparatus to insure free vertical movement consonant with the angle of incline, $\theta$, of the head frame and to insure that space S is continuously bridged. Specifically, adverting to FIGS. 3, 5, and 7, the extender is positioned with respect to the post and filler apparatus such that extender intermediate end portion 22 faces and is parallel to post and filler top member outside planar surface 31 and further, such that crossmember 25 faces and is parallel to top member inside planar surface 32. This configuration is accomplished by the insertion of the end portions of the extender legs, 23 and 24, into the space between post 29 and the first filler rod 36 extending from each end of top member 30. Thus, the post and filler apparatus is effectively "captured" between the crossmembers and the extender intermediate end portion. As a result, the extender may be slideably moved within the support brackets through a finite distance L between the crossmember and extender intermediate end portion 22. The extender, however, is free to move upwardly and downwardly within the post and filler apparatus as the head frame is inclined.

FIGS. 3–6 illustrate operation of the improved head frame and extender. In particular, the position of the extender can be manually slideably changed dependent upon the angle of incline, $\theta$, of the head frame. Adverting specifically to FIGS. 3 and 4, the head frame is shown to be in a horizontal position (i.e., $\theta$ equal to approximately 0°), and the extent of space S between the head frame transverse end 18 and the post and filler apparatus filler rods 36 is de minimis. The extender legs are therefore slideably pushed through the extender brackets such that the extender intermediate end portion rests against the "outside" of the filler rods (FIG. 4). Similarly, crossmembers 25 are vertically beneath the head frame. Thus, in this configuration, the extender is essentially inoperative since space S is so small.

Adverting now to FIGS. 5 and 6, however, the head frame is shown to be adjustably inclined at an angle $\theta$. Accordingly, space S between the head frame transverse end 18 and the post and filler apparatus filler rods 36 is proportionally larger thereby posing a potential danger. The extender, however, is slideably pulled away from the post and filler apparatus such that a crossmember 25 is resting against the "inside" of the filler rods and extender intermediate end portion 22 is at its most distant point from the post and filler apparatus. It can also be readily appreciated that the extender and crossmembers 25 now extend beyond the head frame and serve to bridge or traverse space S thereby preventing inadvertent injury to a patient who may fall or climb in to the space. It can be readily appreciated by one of ordinary skill in the art that the extender can be manually adjusted as required by the angle of incline and resulting space S to insure that any potential danger is alleviated.

MODIFICATIONS

Many modifications and changes are, of course, contemplated by the invention, and the invention should not be limited to that disclosed in the preferred embodiment.

In particular, the extender and crossmembers are, in the preferred embodiment, comprised of essentially two separate portions; however, an extender comprising a single integral piece might easily be accommodated by either existing or new crib designs. Moreover, the shape of the extender may readily be adapted to accommodate other head frame designs or be used on other portions of a bed or crib frame for similar purposes.

Similarly, use of the extender need not be limited to the head portion of the support frame; rather, the extender may readily be adapted to any other adjustable portion (e.g., the foot portion) of the support frame to prevent injury.

Likewise, the extender may also be adapted to any type of head board configuration or safety rail and need not be limited to use with the post and filler apparatus disclosed in the preferred embodiment.

In addition, the component parts of the invention need not be tubular or hollow and there may be applications where it is desirable to have more solid or durable components.

Accordingly, while the presently-preferred form of the improved head frame and extender has been shown and described, and several modifications and changes thereof discussed, persons skilled in the art will readily appreciate that various additional changes and modifications may be made without departing from the spirit of the invention, as defined and differentiated by the following claims.

The invention claimed is:

1. In a bed having a support frame including an adjustable portion, the improvement comprising:

an adjustable portion of said support frame adapted to be adjusted to various angles;

a post and filler apparatus positioned such that there is a space between said post and filler apparatus and said adjustable portion of said support frame, the extent of said space varying with said angle of said support frame adjustable portion;

an extender adapted to selectively bridge said space between said support frame adjustable portion and said post and filler apparatus independent of said angle;

whereby said space between said adjustable portion of said support frame and said post and filler apparatus is bridged by said extender independent of said angle.

2. The improvement according to claim 1 wherein said adjustable portion of said support frame is a head frame.

3. The improvement according to claim 2 wherein said head frame has a left leg, a right leg and a transverse end portion joining said right and left legs.

4. The improvement according to claim 3 wherein said extender has a left leg, a right leg and an intermediate end portion joining said left and right legs.

5. The improvement according to claim 4 and further comprising extender brackets mounted on said left leg and said right leg of said head frame and adapted to slideably receive said left leg and said right leg of said extender.

6. The improvement according to claim 5 and further comprising support brackets mounted on said left leg and said right leg of said head frame adjacent said extender brackets and adapted to support said left leg and said right leg of said extender.

7. The improvement according to claim 5 wherein said extender bracket comprises a hollow body member having two open ends; bushings slideably inserted into either open end of said hollow body member, said bushings having an aperture capable of slideably receiving one of said extender legs.

8. The improvement according to claim 5 wherein said extender is slideably mounted on said head frame.

9. The improvement according to claim 5 wherein said extender is adapted to move slideably within said extender support bracket.

10. The improvement according to claim 7 further comprising stop caps mounted on the ends of said left leg and said right leg of said extender for maintaining said extender legs in said extender brackets.

11. The improvement according to claim 4 and further comprising a plurality of crossmembers extending from said left leg to said right leg of said extender.

12. The improvement according to claim 11 wherein said crossmembers are parallel to said extender intermediate end portion.

13. The improvement according to claim 1 wherein said extender is a hollow tube.

14. The improvement according to claim 11 wherein said crossmembers are tubular and have two separable portions, said one separable portion mounted on said left leg of said extender, said other separable portion mounted on said right leg of said extender, said two separable portions of said crossmembers being adapted to be slideably engaged.

15. The improvement according to claim 1 wherein said post and filler apparatus comprises an elongated hollow rectangular top member having a left end and a right end; an inside surface, an outside surface and a bottom surface; a plurality of spaced filler rods mounted on and extending downwardly from said top member bottom surface; and post members, mounted on and extending downwardly from said left end and said right end of said top member.

16. The improvement according to claim 15 wherein said extender is operatively arranged such that said extender intermediate end portion is positioned facing the outside edge of said top member and said crossmembers are positioned facing the inside edge of said top member, wherein said left leg and said right leg of said extender are interposed between said filler rods and said post member at either end of said top member and wherein said extender is able to slide vertically upward or downward within said post and filler apparatus.

* * * * *